US009265992B2

(12) United States Patent
Nakamura

(10) Patent No.: US 9,265,992 B2
(45) Date of Patent: Feb. 23, 2016

(54) GOLF CLUB

(71) Applicant: DUNLOP SPORTS CO. LTD., Kobe-shi, Hyogo (JP)

(72) Inventor: Takashi Nakamura, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 326 days.

(21) Appl. No.: 13/860,737

(22) Filed: Apr. 11, 2013

(65) Prior Publication Data

US 2013/0288816 A1 Oct. 31, 2013

(30) Foreign Application Priority Data

Apr. 27, 2012 (JP) ..... 2012-103277

(51) Int. Cl.
*A63B 53/02* (2015.01)

(52) U.S. Cl.
CPC ..... *A63B 53/02* (2013.01); *A63B 2053/023* (2013.01)

(58) Field of Classification Search
CPC ..... A63B 2053/023
USPC ..... 473/305–307, 246, 314
See application file for complete search history.

(56) References Cited

U.S. PATENT DOCUMENTS

| | | | | |
|---|---|---|---|---|
| 8,147,350 | B2 * | 4/2012 | Beach et al. | 473/307 |
| 8,177,661 | B2 * | 5/2012 | Beach et al. | 473/307 |
| 8,715,103 | B1 * | 5/2014 | Aguinaldo et al. | 473/307 |
| 8,758,153 | B2 * | 6/2014 | Sargent et al. | 473/246 |
| 8,801,537 | B1 * | 8/2014 | Seluga et al. | 473/307 |
| 8,840,487 | B2 * | 9/2014 | Okot | 473/306 |
| 8,926,447 | B2 * | 1/2015 | Jertson et al. | 473/307 |
| 8,936,514 | B2 * | 1/2015 | Sato | 473/296 |
| 8,961,330 | B2 * | 2/2015 | Zimmerman et al. | 473/307 |
| 9,033,821 | B2 * | 5/2015 | Beach et al. | 473/334 |
| 2009/0286618 | A1 | 11/2009 | Beach et al. | |
| 2009/0286619 | A1 | 11/2009 | Beach et al. | |

* cited by examiner

*Primary Examiner* — Gene Kim
*Assistant Examiner* — Matthew B Stanczak
(74) *Attorney, Agent, or Firm* — Birch Stewart Kolasch & Birch LLP

(57) ABSTRACT

A golf club 2 includes a head 4, a shaft 6, and a fixing member Fx1. The head 4 has a hosel part 4*h* capable of swingably supporting the shaft 6. The shaft 6 has a tip connecting part 6*t* capable of being connected to the fixing member Fx1. The fixing member Fx1 has a connector 12 capable of being connected to the shaft 6, a first sliding member S1 capable of engaging the connector 12 with a plurality of positions in a first direction D1, and a second sliding member S2 capable of engaging the first sliding member S1 with a plurality of positions in a second direction D2. A movement of the connector 12 in the first direction D1 and a movement of the connector 12 in the second direction D2 are independent of each other.

17 Claims, 15 Drawing Sheets

GOLF CLUB

The present application claims priority on Patent Application No. 2012-103277 filed in JAPAN on Apr. 27, 2012, the entire contents of which are hereby incorporated by reference.

BACKGROUND OF THE INVENTION

1. Field of the Invention

The present invention relates to a golf club.

2. Description of the Related Art

A golf club capable of adjusting a loft angle, a lie angle, and a face angle is proposed. Japanese Patent Application Laid-Open No. 2009-291602 (US2009/0286618, US2009/0286619) discloses a golf club in which a sleeve is attached to the tip of a shaft. A shaft hole into which the shaft is inserted is formed in the sleeve. The axis line of the shaft hole is inclined with respect to the axis line of the sleeve. Thereby, the axis line of the shaft is inclined with respect to the axis line of the sleeve. Aloft angle, a lie angle, and a face angle can be adjusted by rotating the sleeve with respect to a hosel.

SUMMARY OF THE INVENTION

In the golf club of each of the documents, the loft angle, the lie angle, and the face angle are changed while being linked. The linkage reduces a degree of freedom of angle adjustment.

It is an object of the present invention to provide a golf club having a high degree of freedom in the angle adjustment.

A golf club of the present invention includes a head, a shaft, and a fixing member for fixing the shaft. The head has a hosel part capable of swingably supporting the shaft. The shaft has a tip connecting part capable of being connected to the fixing member. The fixing member has a connector capable of being connected to the shaft, a first sliding member capable of engaging the connector with a plurality of positions in a first direction, and a second sliding member capable of engaging the first sliding member with a plurality of positions in a second direction. A movement of the connector in the first direction and a movement of the connector in the second direction are linearly perpendicular to each other.

Preferably, a lie angle can be changed by any one of the movement of the connector in the first direction and the movement of the connector in the second direction, and a loft angle can be changed by the other.

Preferably, the fixing member has a first indicating part indicating a position of the connector in the first direction. Preferably, the first indicating part can be visually recognized from a sole surface side of the head.

Preferably, the fixing member has a second indicating part indicating a position of the connector in the second direction. Preferably, the second indicating part can be visually recognized from a sole surface side of the head.

Preferably, the connector has a screw and a screw position fixing member. Preferably, the tip connecting part has a female screw part. Preferably, the shaft is fixed to the head by screw combination of the screw with the female screw part.

Preferably, the screw position fixing member and the first sliding member can be engaged at the plurality of positions in the first direction.

Preferably, the engagement between the screw position fixing member and the first sliding member is fixed by an axial force of the screw combination.

Preferably, the golf club further includes an elastic member biasing the first sliding member in a direction in which the first sliding member is engaged with the second sliding member.

Preferably, the engagement between the first sliding member and the second sliding member is released by moving the first sliding member in a direction opposite to the biasing direction of the elastic member against an biasing force of the elastic member. Preferably, the first sliding member can be moved in the second direction by releasing the engagement.

Preferably, engagement between the connector and the first sliding member is achieved by an uneven structure A. Preferably, engagement between the first sliding member and the second sliding member is achieved by an uneven structure B. Preferably, an uneven overlapping depth in the uneven structure B is different from an uneven overlapping depth in the uneven structure A.

DESCRIPTION OF THE PREFERRED EMBODIMENTS

Hereinafter, the present invention will be described in detail based on preferred embodiments with appropriate references to the drawings.

In the present application, the terms showing "upper" and "lower" are used. Unless particularly described, an "upper side" in the present application means a grip side, and a "lower side" in the present application means a sole side. Unless particularly described, the upper side and the lower side in the present application are determined based on a combined state (which will be described later).

Figure 1:
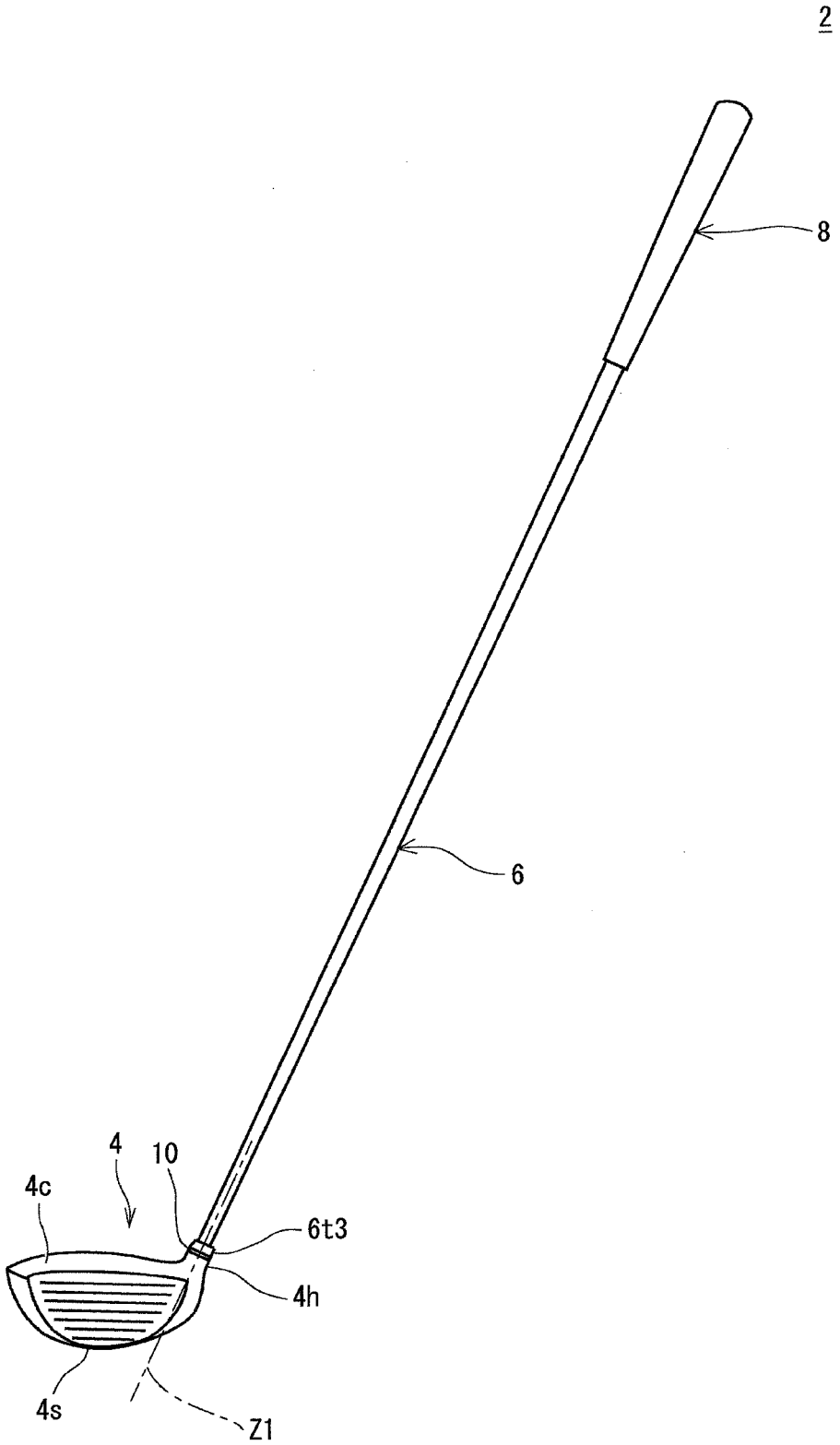
FIG. 1 shows a golf club according to an embodiment of the present invention.

As shown in FIG. 1, a golf club 2 has a head 4, a shaft 6, and a grip 8. The head 4 is fixed to the tip part of the shaft 6. The grip 8 is mounted to the butt end part of the shaft 6.

[Combined State and Uncombined State]

In the golf club 2, the shaft 6 can be attached to/detached from the head 4. A state where the shaft 6 is completely combined with the head 4 is referred to as a combined state. The golf club 2 in the combined state is taken for use. FIG. 1 shows the golf club 2 in the combined state. In the golf club 2 in the combined state, the shaft 6 is prevented from coming off the head 4. That is, the come-off prevention is achieved. In the golf club 2 in the combined state, the rotation of the shaft 6 with respect to the head 4 is prevented. That is, the rotation prevention is achieved. On the other hand, a state where the shaft 6 can be removed from the head 4 is referred to as an uncombined state. In the following embodiment, a state where a screw part 18*a* (which will be described later) is completely removed from a screw hole 6*t*2 (which will be described later) is the uncombined state.

The head 4 has a crown 4*c*, a sole 4*s*, and a hosel part 4*h*.

The type of the head 4 is not limited. The head 4 of the embodiment is a wood type golf club. The head 4 may be a utility type head, a hybrid type head, an iron type head, and a putter head or the like.

The shaft 6 is not limited. For example, a carbon shaft and a steel shaft can be used.

Figure 2:
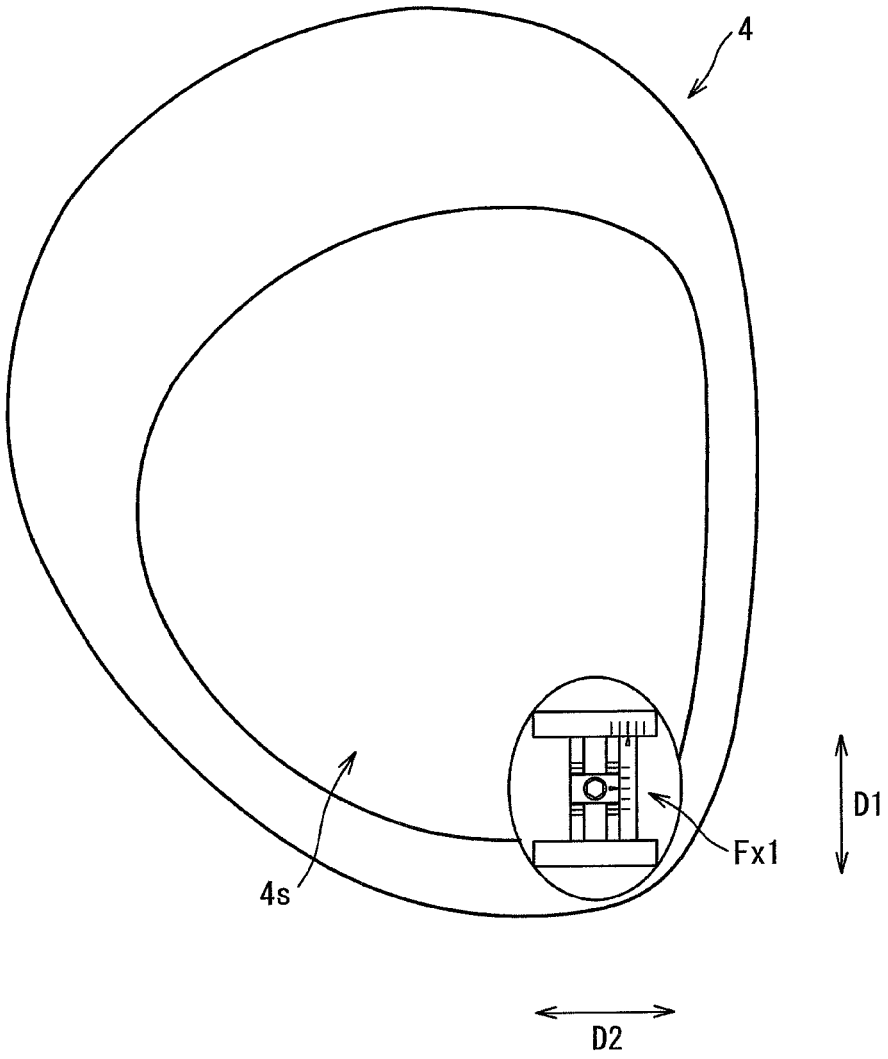
FIG. 2 is a bottom view of the golf club of FIG. 1.

FIG. 2 is a bottom view of the golf club 2. FIG. 2 is a view of the head 4, as viewed from the sole side. The head 4 includes a fixing member Fx1 for fixing the shaft 6. The fixing member Fx1 is located within the head 4.

Figure 3:
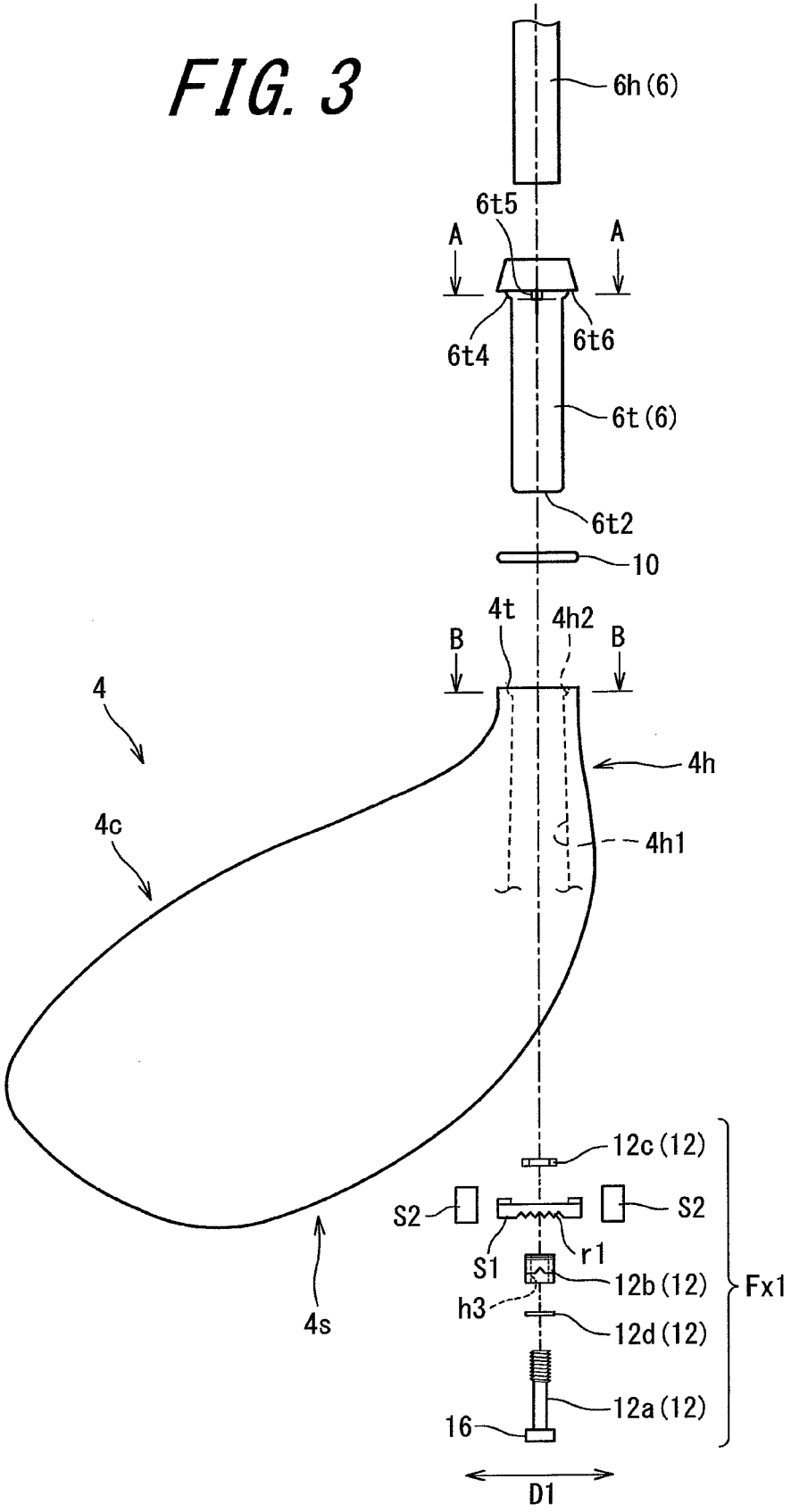
FIG. 3 is an exploded view of the golf club of FIG. 1.

FIG. 3 is an exploded view of the golf club 2 in the vicinity of the head. The shaft 6 has a shaft body 6*h* and a tip connecting part 6*t*. The tip connecting part 6*t* can be connected to the fixing member Fx1. The golf club 2 has an annular elastic body 10. An example of the annular elastic body 10 is a so-called O ring.

The fixing member Fx1 has a connector 12, a first sliding member S1, and a second sliding member S2. The connector 12 has a screw 12*a*, a screw position fixing member 12*b*, a lock part forming body 12*c*, and an annular elastic body 12*d*. In the embodiment, the lock part forming body 12*c* is a hexagonal nut. The lock part forming body 12*c* can form a flange-shaped projection part. An example of the annular elastic body 12*d* is a so-called O ring. The annular elastic body 12*d* can be deformed corresponding to the inclination of the screw 12*a* associated with angle adjustment. A head part 16 of the screw 12*a* can be stably supported by the screw position fixing member 12*b* according to the deformation. The details of the fixing member Fx1 will be described later.

The connector 12 can be connected to the shaft 6. An example of the connected structure will be described later. The first sliding member S1 can engage the connector 12 with a plurality of positions in a first direction D1. The engagement is fixed by the axial force of the screw 12*a*. The engagement will be described later. The second sliding member S2 can engage the first sliding member S1 with a plurality of positions in a second direction D2. The engagement is fixed by the axial force of the screw 12*a*. The engagement will be described later.

Figure 4A:
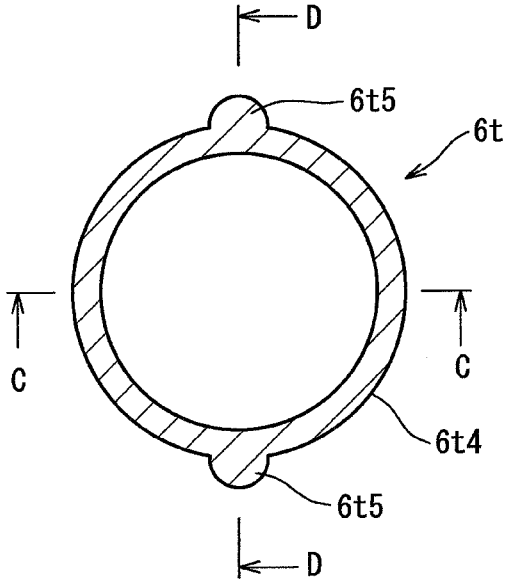
FIG. 4A is a cross-sectional view taken along line A-A of FIG. 3.
Figure 4B:
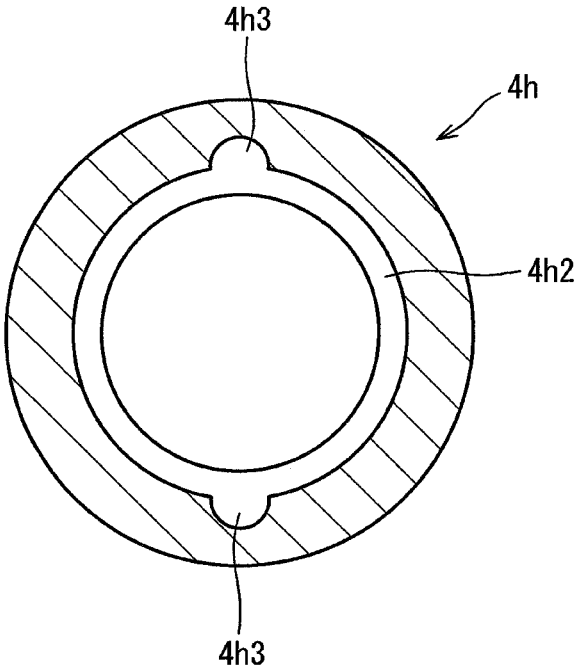
FIG. 4B is a cross-sectional view taken along line B-B of FIG. 3.
Figure 5:
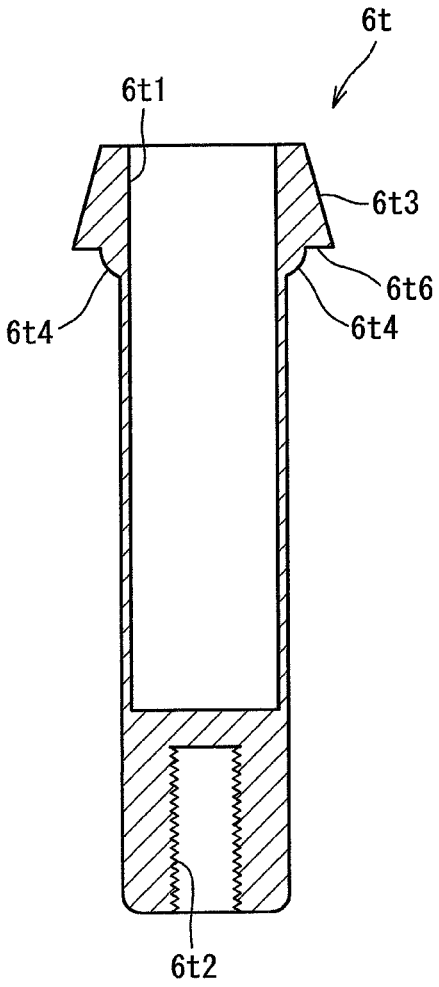
FIG. 5 is a cross-sectional view of a tip connecting part taken along line C-C of FIG. 4A.
Figure 6:
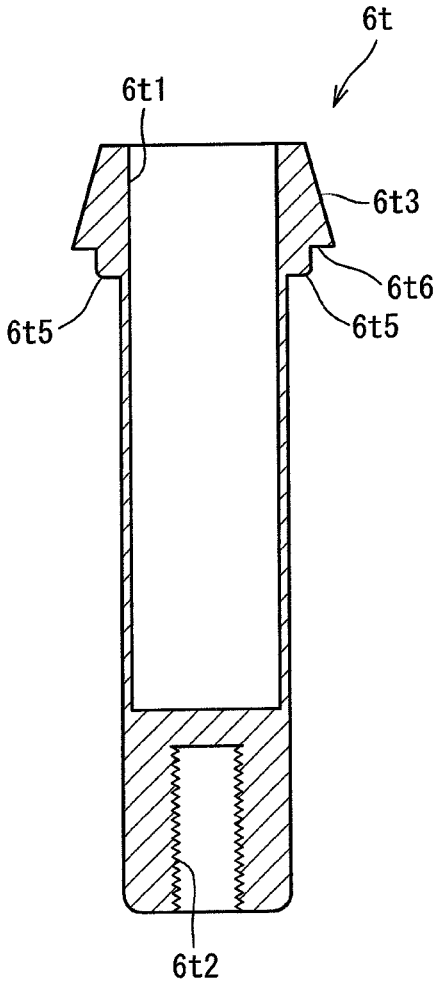
FIG. 6 is a cross-sectional view of the tip connecting part taken along line D-D of FIG. 4A.

FIG. 4A is a cross-sectional view taken along the line A-A of FIG. 3. FIG. 4B is a cross-sectional view taken along the line B-B of FIG. 3. FIG. 5 is a cross-sectional view of the tip connecting part 6*t*. FIG. 5 is a cross-sectional view taken along the central axis line of the tip connecting part 6*t*. FIG. 5 is a cross-sectional view taken along the line C-C of FIG. 4A. FIG. 6 is also a cross-sectional view of the tip connecting part 6*t* taken along the central axis line of the tip connecting part 6*t*. FIG. 6 is a cross-sectional view taken along the line D-D of FIG. 4A. In the embodiment, the tip connecting part 6*t* is a sleeve. The tip connecting part 6*t* may be integrally formed with the shaft body 6*h*. Although not illustrated, the other example of the tip connecting part is a screw hole formed in the tip part of the shaft. The screw hole is preferably coaxial with a shaft axis line Z1. A portion having the same shape as that of the tip connecting part 6*t* may be integrally formed with the shaft body 6*h*. A projection part having a protrusion surface 6*t*6 may be integrally formed with the shaft body 6*h*. For example, the protrusion surface 6*t*6 can be formed by partially thickening the shaft body 6*h*.

As shown in FIGS. 4A, 5, and 6, the tip connecting part 6*t* has a shaft hole 6*t*1, a screw hole 6*t*2, a conical outer surface part 6*t*3, a projection curved surface part 6*t*4, a rotation prevention projection part 6*t*5, and a bump surface 6*t*6. The conical outer surface part 6*t*3 is located in the upper end part of the tip connecting part 6*t*. The conical outer surface part 6*t*3 has a diameter decreased upward. The protrusion surface 6*t*6 is located in the lower end of the conical outer surface part 6*t*3. The screw hole 6*t*2 is a female screw part. The axis line of the screw hole 6*t*2 coincides with the shaft axis line Z1.

The projection curved surface part 6*t*4 exists along substantially the entire circumferential direction. That is, the projection curved surface part 6*t*4 exists along the entire circumferential direction except for a portion in which the rotation prevention projection part 6*t*5 exists. On the other hand, the rotation prevention projection parts 6*t*5 are provided at two places in the circumferential direction. The rotation prevention projection parts 6*t*5 may be provided at one or more places in the circumferential direction.

As shown in FIG. 1, the conical outer surface part 6*t*3 is exposed to the outside in the golf club 2 in the combined state. In the golf club 2 in the combined state, the conical outer surface part 6*t*3 looks like a ferrule.

The hosel part 4*h* has a hosel hole 4*h*1 (which will be described later). Furthermore, as shown in FIG. 4B, the hosel part 4*h* has an end face 4*t*, a recessed curved surface part 4*h*2, and a rotation prevention recessed part 4*h*3. The end face 4*t* is the upper end face of the hosel part 4*h*. The end face 4*t* is formed so as to surround the circumference of the upper side opening part of the recessed curved surface part 4*h*2. The recessed curved surface part 4*h*2 is located on the inner side of the end face 4*t*. The recessed curved surface part 4*h*2 is located on the upper side of the hosel hole 4*h*1. The lower end edge of the recessed curved surface part 4*h*2 coincides with the upper end edge of the hosel hole 4*h*1, and the upper end edge of the recessed curved surface part 4*h*2 coincides with the inner side edge of the end face 4*t*. The inner diameter of the recessed curved surface part 4*h*2 is set greater as getting closer to the end face 4*t*. The rotation prevention recessed part 4*h*3 is located on the inner side of the end face 4*t*.

Figure 7:
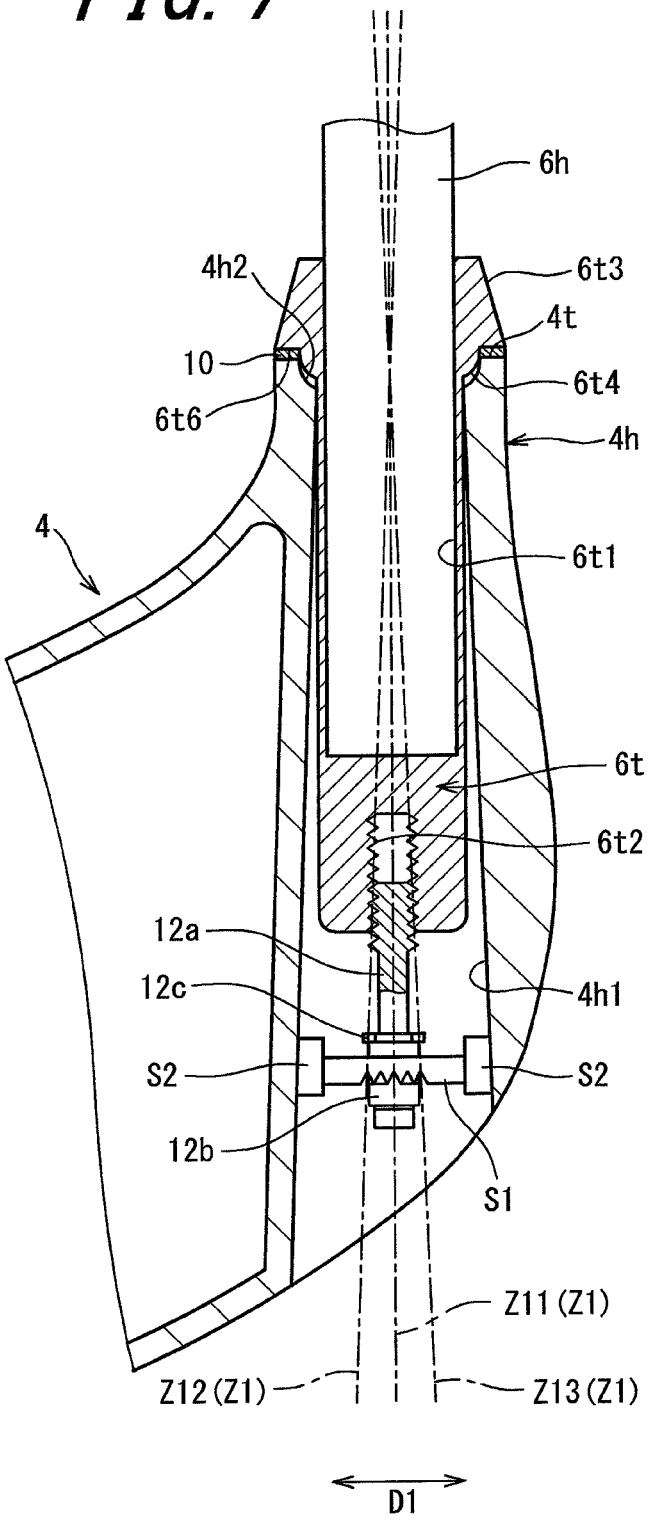
FIG. 7 is a cross-sectional view of the golf club of FIG. 1 in the vicinity of a hosel.

FIG. 7 is a cross-sectional view of the golf club 2 in the vicinity of the hosel. FIG. 7 is a cross-sectional view taken along the shaft axis line Z1.

The hosel part 4*h* can swingably support the shaft 6. In a portion into which the tip connecting part 6*t* can be inserted, the hosel hole 4*h*1 widens toward the lower part thereof (see FIG. 7). The shape of the hosel hole 4*h*1 allows lie angle adjustment and loft angle adjustment which will be described later. That is, the hosel hole 4*h*1 forms a space capable of allowing angle adjustment. Meanwhile, the end face 4*t* of the hosel part 4*h* can support an axial force acting on the tip connecting part 6*t*.

The protrusion surface 6*t*6 can be inclined with respect to the end face 4*t* of the hosel part 4*h* by the swinging of the tip connecting part 6*t*. The annular elastic body 10 can be deformed corresponding to the inclination. In all adjusted angles, a gap between the protrusion surface 6*t*6 and the end face 4*t* is filled by the deformation of the annular elastic body 10. A force received from the protrusion surface 6*t*6 is dispersed in the entire circumferential direction of the end face 4*t* by the existence of the annular elastic body 10. The tip connecting part 6*t* is stably supported by the dispersion.

In the embodiment, the projection curved surface part 6*t*4 and the recessed curved surface part 4*h*2 are brought into contact with each other. The contact is achieved in all the adjusted angles. The contact is over the entire circumferential direction. That is, the projection curved surface part 6t4 is brought into contact with the recessed curved surface part 4h2 over the entire circumferential direction. The contact is line contact and/or surface contact. The contact secures the swinging of the tip connecting part 6t and more stably supports the tip connecting part 6t.

The tip connecting part 6t is fixed to the tip part of the shaft body 6h. The tip part of the shaft body 6h is inserted into the shaft hole 6t1. The shaft body 6h is bonded to the shaft hole 6t1. The bonding is achieved by an adhesive. The inner diameter of the shaft hole 6t1 is substantially equal to the outer diameter of the tip part of the shaft body 6h.

[Rotation Prevention]

The rotation prevention of the shaft 6 is achieved by rotation prevention engagement between the tip connecting part 6t and the hosel part 4h. In the embodiment, the rotation prevention engagement is engagement between the rotation prevention projection part 6t5 and the rotation prevention recessed part 4h3 (see FIG. 4). An axial force caused by the screw combination of the screw 12a with the screw hole 6t2 contributes to the maintenance of the rotation prevention engagement.

[Come-off Prevention]

The come-off prevention of the shaft 6 is achieved by a come-off prevention mechanism between the tip connecting part 6t and the fixing member Fx1. In the embodiment, the come-off prevention mechanism is screw combination of the screw 12a with the screw hole 6t2.

The axial force produced by the screw combination is received by the upper end part of the hosel part 4h. The axial force is received by the end face 4t and/or the recessed curved surface part 4h2 of the hosel part 4h. The shaft 6 is supported by the hosel part 4h.

[Fixing Member Fx1]

Figure 8:
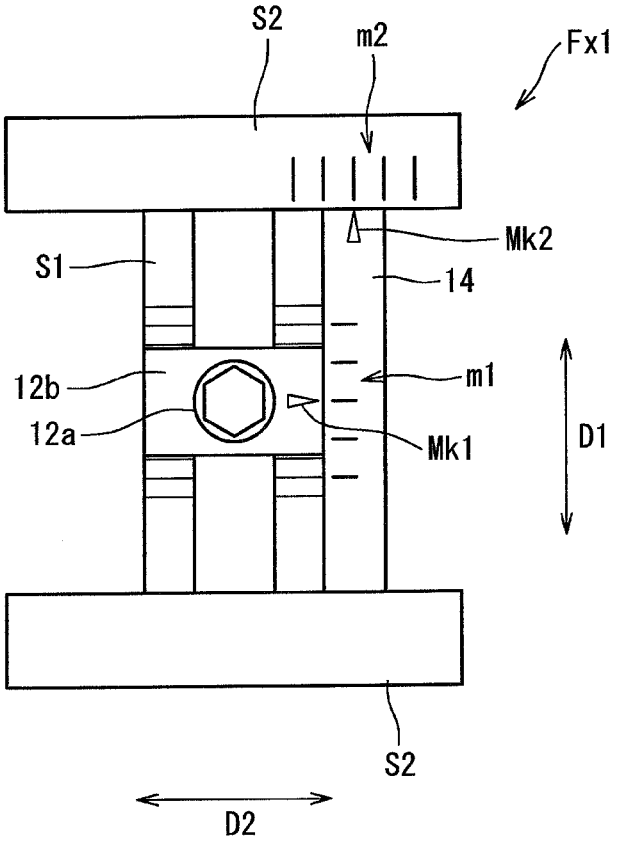
FIG. 8 is a bottom view of a fixing member.

FIG. 8 is a bottom view of the fixing member Fx1. FIG. 8 shows the fixing member Fx1, as viewed from the sole side. In addition to the above-mentioned constitution, the fixing member Fx1 has a scale member 14. Although the scale member 14 is also illustrated in FIGS. 2 and 12, the description of the scale member 14 is omitted in the other drawings.

Figure 9:
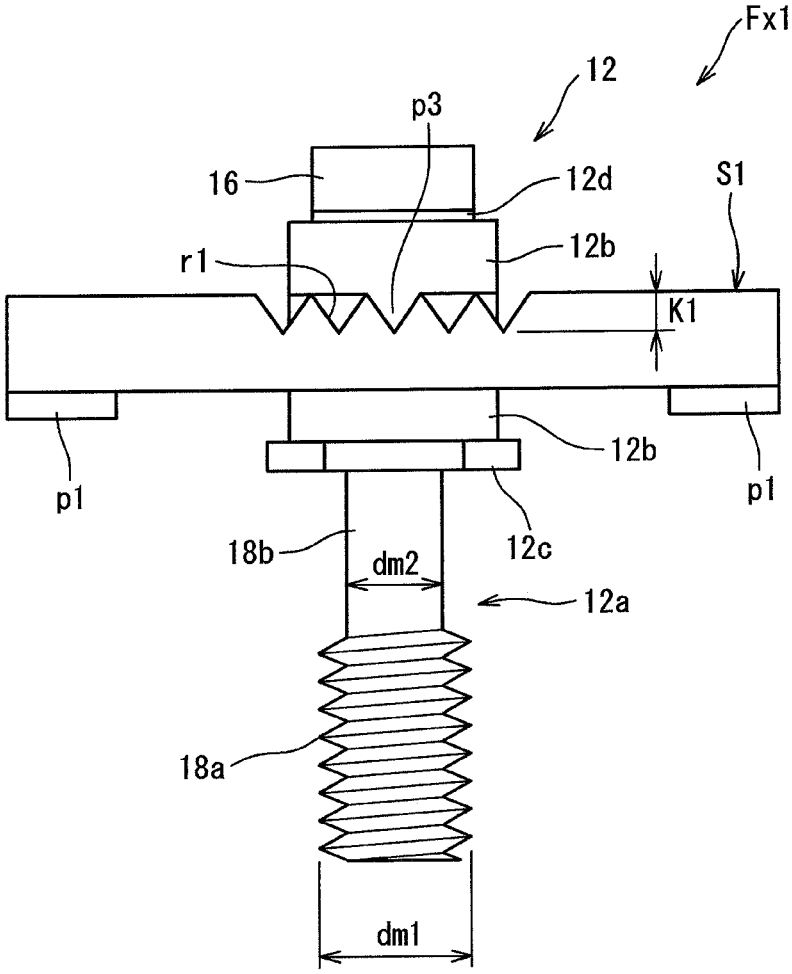
FIG. 9 is a side view showing a part of the fixing member.
Figure 10:
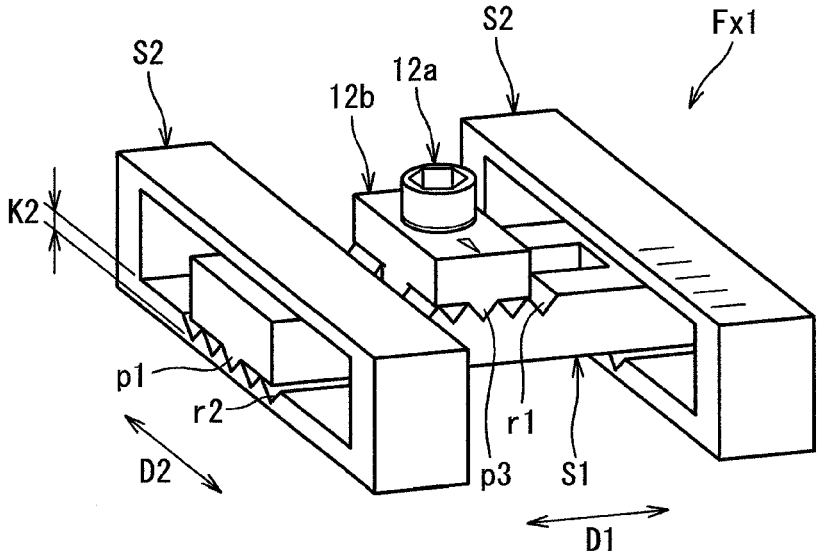
FIG. 10 is a perspective view of the fixing member.
Figure 11:
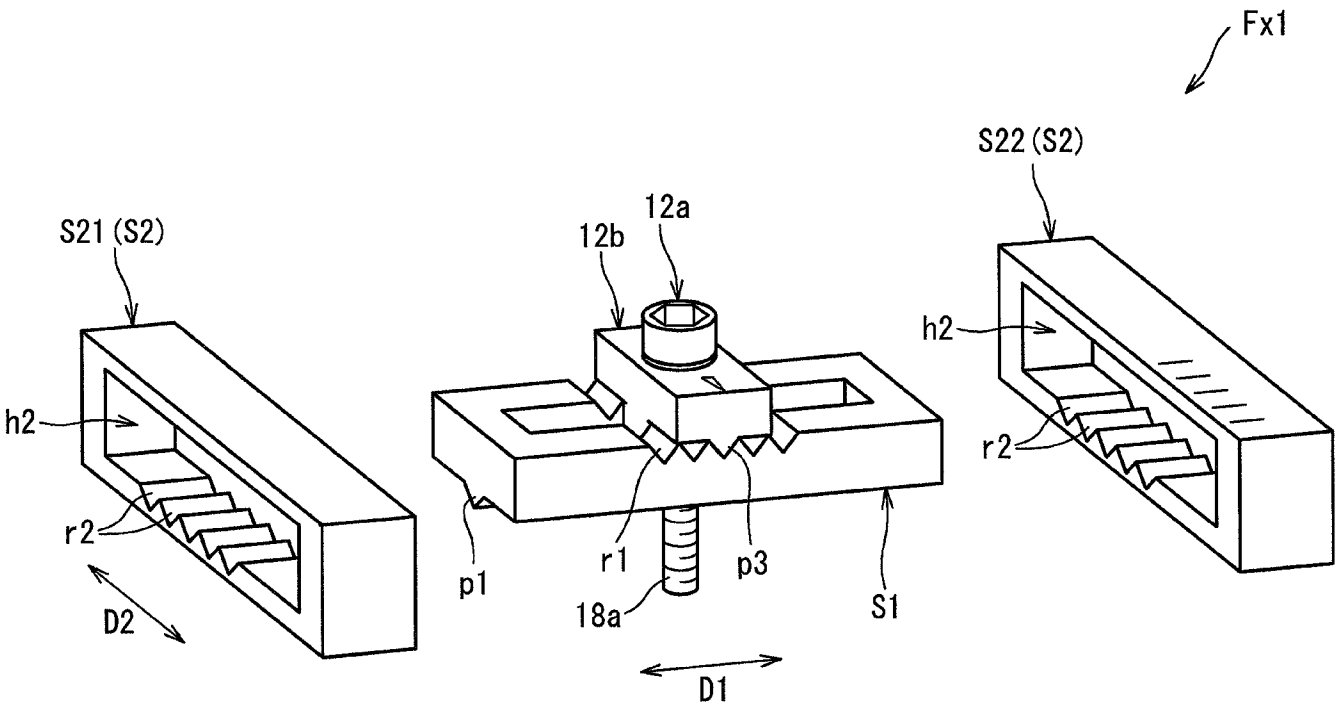
FIG. 11 is an exploded perspective view of the fixing member of FIG. 10.

FIG. 9 is a side view of the fixing member Fx1. However, in FIG. 9, the description of the second sliding member S2 is omitted. FIG. 10 is a perspective view of the fixing member Fx1. FIG. 11 is a partial exploded perspective view of the fixing member Fx1. FIG. 12 is an exploded perspective view of the fixing member Fx1. However, in FIG. 12, the description of the second sliding member S2 is omitted.

Figure 14:
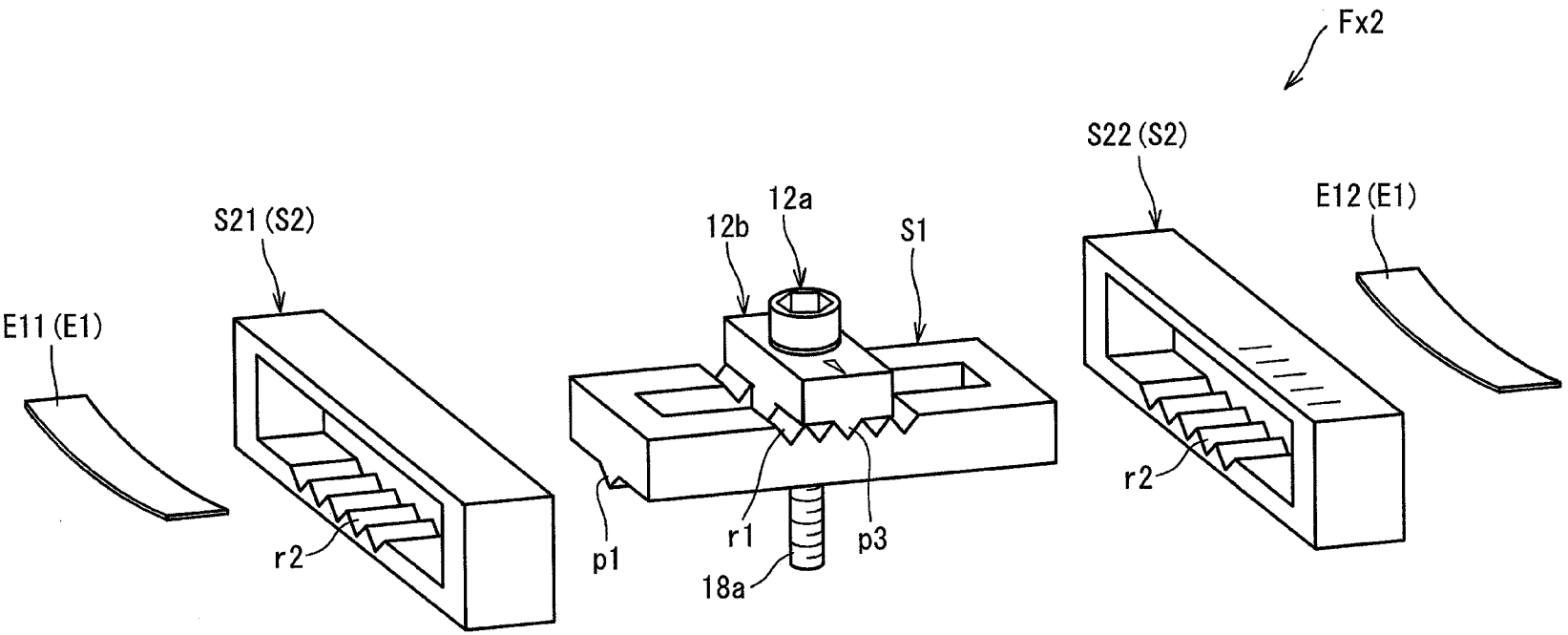
FIG. 14 is an exploded perspective view of the fixing member of FIG. 13.

As compared with FIG. 3, the upside and the downside are reversed in FIGS. 9 to 12. In FIGS. 9 to 12, the upper side of the drawing is the sole side. In FIGS. 11 and 14, the axis direction of the screw 12a is the up-and-down direction of the drawing.

Figure 12:
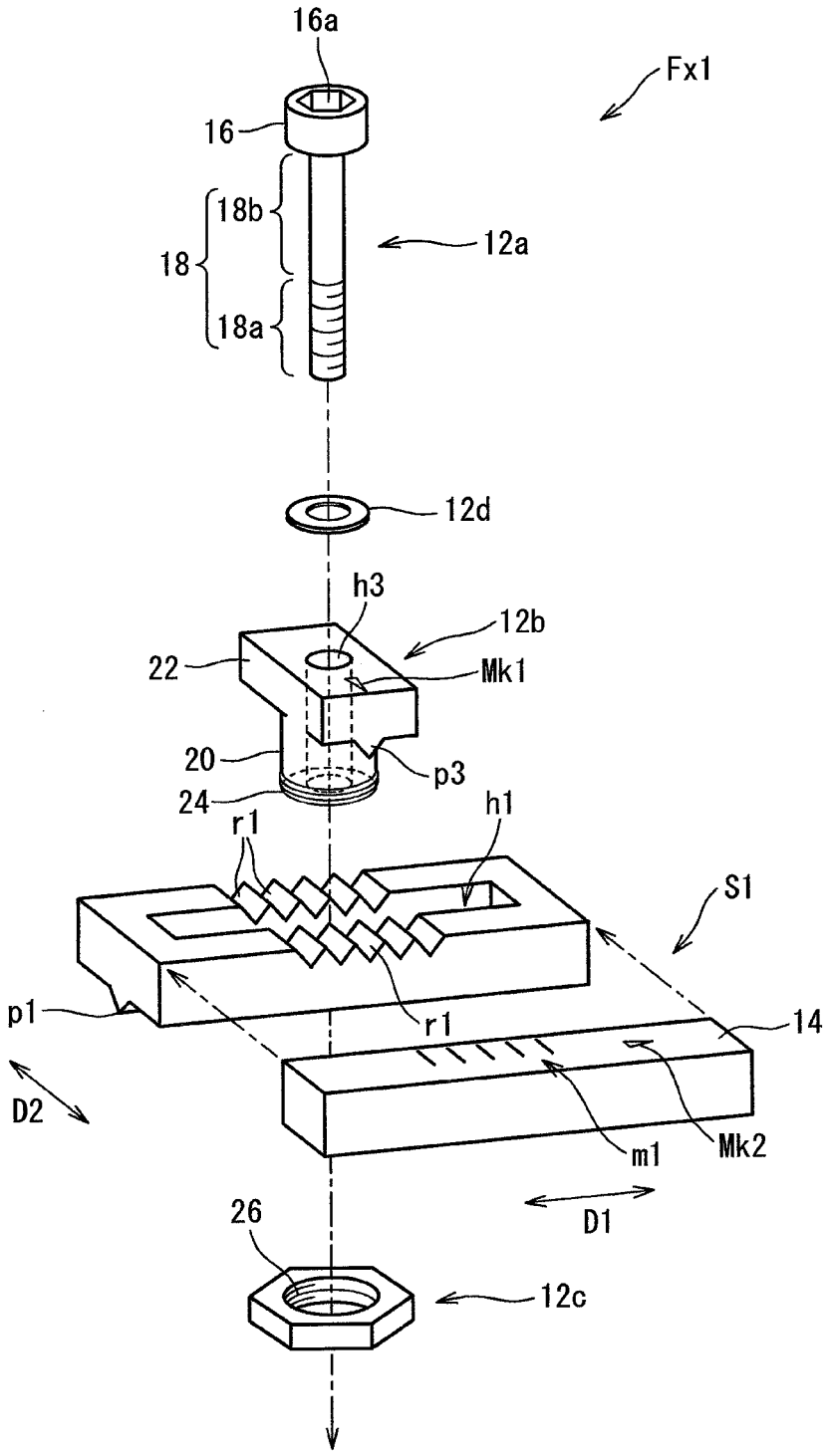
FIG. 12 is a perspective view in which a part of FIG. 11 is further exploded.

As shown in FIG. 12, the screw 12a has a head part 16 and an axis part 18. The head part 16 has a non-annular hole 16a for rotating the screw 12a. The screw 12a can be rotated by the non-annular hole 16a, using a dedicated jig or the like. The axis part 18 has a screw part 18a and a non-screw part 18b. The screw part 18a is a male screw. The screw part 18a occupies a part of the axis part 18. The screw part 18a is provided in the tip part of the axis part 18. The non-screw part 18b occupies a part of the axis part 18. The outer surface of the non-screw part 18b is a circumferential face. The maximum outer diameter dm1 of the screw part 18a is greater than the outer diameter dm2 of the non-screw part 18b (see FIG. 9).

As shown in FIG. 12, the first sliding member S1 has an almost rectangular parallelepiped shape. The longitudinal direction of the almost rectangular parallelepiped coincides with the first direction D1. The first sliding member S1 has a plurality of recessed parts r1, a through-hole h1, and an engaging projection part p1. The through-hole h1 is a long hole extending in the first direction D1. The longitudinal direction of the long hole coincides with the first direction D1. The movement of the screw position fixing member 12b which will be described later is guided in the first direction D1 by the through-hole h1. The engaging projection part p1 is provided on a surface opposite to a surface in which the recessed parts r1 are formed. The first sliding member S1 has a scale part m1. The scale part m1 shows the position of the first direction D1.

The recessed parts r1 are formed at a plurality of positions in the first direction D1. In the embodiment, the recessed parts r1 are formed at five positions in the first direction D1.

The shape of the recessed part r1 corresponds to the shape of an engaging projection part p3 (which will be described later). In the embodiment, the recessed part r1 is a groove. The cross-sectional shape of the recessed part r1 is a V-shape.

As shown in FIG. 11, the second sliding member S2 has a plurality of recessed parts r2 and a hole h2. In the embodiment, the second sliding member S2 is constituted by two members S21 and S22 having the same shape. The member S21 has an almost rectangular parallelepiped shape, and the longitudinal direction of the almost rectangular parallelepiped shape coincides with the second direction D2. The longitudinal direction of the hole h2 of the member S21 coincides with the second direction D2. The member S22 has an almost rectangular parallelepiped shape, and the longitudinal direction of the almost rectangular parallelepiped shape coincides with the second direction D2. The longitudinal direction of the hole h2 of the member S22 coincides with the second direction D2. The longitudinal direction of the member S21 is parallel to the longitudinal direction of the member S22. A gap exists between the member S21 and the member S22. The gap allows the movement of the screw position fixing member 12b in the first direction D1.

As shown in FIG. 11, one end part of the first sliding member S1 is inserted into the hole h2 of the member S21, and the other end part of the first sliding member S1 is inserted into the hole h2 of the member S22. The movement of the first sliding member S1 can be guided in the second direction D2 by the holes h2 of the members S21 and S22.

The recessed parts r2 are formed at a plurality of positions in the second direction D2. In the embodiment, the recessed parts r2 are formed at five positions in the second direction D2. Therefore, a loft angle can be adjusted in five stages.

The shape of the recessed part r2 corresponds to the shape of the engaging projection part p1. In the embodiment, the recessed part r2 is a groove. The plurality of recessed parts r2 are disposed in parallel in the second direction D2 without any gap. The cross-sectional shape of the recessed part r2 is a V-shape. The recessed part r2 and the engaging projection part p1 can be engaged with each other. The position of the first sliding member S1 in the second direction D2 is determined by the engagement. Therefore, the position of the screw position fixing member 12b in the second direction D2 is determined. Thereby, the position of the screw 12a in the second direction D2 is determined. The engagement between the engaging projection part p1 and the recessed part r2 is fixed by the axial force of the screw 12a produced in the combined state.

The second sliding member S2 (the member S21 and the member S22) is fixed to a head body. In respect of a fixing strength, the second sliding member S2 (the member S21 and the member S22) is preferably welded to the head body. In not only the combined state but also the uncombined state, the first sliding member S1 does not fall off from the second sliding member S2.

As shown in FIG. 12, the screw position fixing member 12*b* has a through-hole h3, an insertion part 20, a noninsertion part 22, and an engaging projection part p3. The insertion part 20 has an almost cylindrical shape. The noninsertion part 22 has an almost rectangular parallelepiped shape. The noninsertion part 22 is combined with one end of the insertion part 20. The longitudinal direction of the noninsertion part 22 coincides with the second direction D2. The longitudinal direction of the noninsertion part 22 crosses the longitudinal direction of the first sliding member S1. The axis direction of the through-hole h3 coincides with the axis direction of the insertion part 20. The through-hole h3 and the insertion part 20 are coaxial with each other. The through-hole h3 passes through the insertion part 20 and the noninsertion part 22. Although not illustrated, the through-hole h3 is a screw hole. That is, the through-hole h3 is a female screw. The female screw of the through-hole h3 is fitted to the screw part 18*a* of the screw 12*a*. The engaging projection parts p3 are formed on both the end parts of the noninsertion part 22 in the second direction D2.

The screw part 18*a* is screwed into the through-hole h3 in the assembly of the fixing member Fx1. When the screwing is further advanced, the entire screw part 18*a* passes through the through-hole h3. Eventually, a state where only the non-screw part 18*b* exists within the through-hole h3 is brought about. Since the outer diameter of the non-screw part 18*b* is thinner than the inner diameter of the through-hole h3, the non-screw part 18*b* can be freely moved in the through-hole h3. On the other hand, unless the screw 12*a* is rotated, the non-screw part 18*b* cannot pass through the through-hole h3. The falling-off of the screw 12*a* in the uncombined state is prevented by the constitution.

The inner diameter (minimum inner diameter) of the through-hole h3 is greater than the outer diameter of the non-screw part 18*b*. The non-screw part 18*b* can pass through the through-hole h3. The non-screw part 18*b* can pass through the through-hole h3 without causing the axis rotation of the screw 12*a*. On the other hand, the screw part 18*a* cannot pass through the through-hole h3 unless the axis rotation of the screw 12*a* is caused. This is because the female screw of the through-hole h3 has a relation to be screwed to the male screw of the screw part 18*a*.

The shape of the engaging projection part p3 corresponds to the shape of the recessed part r1. The engaging projection part p3 and the recessed part r1 can be engaged with each other. In the embodiment, the engaging projection part p3 is a rib extending straight. The cross-sectional shape of the engaging projection part p3 is a V-shape.

The position of the screw position fixing member 12*b* in the first direction D1 is determined by the engagement between the engaging projection part p3 and the recessed part r1. Therefore, the position of the screw 12*a* in the first direction D1 is determined by the engagement. The engagement between the engaging projection part p3 and the recessed part r1 is fixed by the axial force of the screw 12*a* produced in the combined state.

A screw part 24 is formed in the end part of the insertion part 20 (see FIG. 12). The screw part 24 is a male screw. The screw part 24 is fitted to a female screw 26 of the lock part forming body 12*c*.

The insertion part 20 can be inserted into the through-hole h1. On the other hand, the noninsertion part 22 cannot be inserted into the through-hole h1.

In the assembly of the fixing member Fx1, the lock part forming body 12*c* is screwed to the screw part 24 after the insertion part 20 is inserted into the through-hole h1. The lock part forming body 12*c* is fixed to the screw position fixing member 12*b* by the screwing. The flange-shaped projection part is formed by the lock part forming body 12*c*. The flange-shaped projection part is located in the end part of the insertion part 20. The flange-shaped projection part is projected in a direction enlarging the outer shape of the insertion part 20. The flange-shaped projection part is projected in the radial direction of the through-hole h3. The lock part forming body 12*c* fixed to the screw position fixing member 12*b* cannot pass through the through-hole h1. The screw position fixing member 12*b* does not fall off from the fixing member Fx1 in the uncombined state by the existence of the lock part forming body 12*c*.

[Lie Angle Adjustment]

In the embodiment, the movement of the connector 12 in the first direction D1 enables the lie angle adjustment. The movement of the connector 12 in the first direction D1 may enable the loft angle adjustment. For example, the fixing member Fx1 may be rotated by 90 degrees and fixed to the head 4, in order to realize this.

An axis line Z11, an axis line Z12, and an axis line Z13 are shown as three shaft axis lines Z1 capable of being set in FIG. 7. The shaft axis line Z12 realizes a flat lie angle as compared with the shaft axis line Z11. As shown in FIG. 11, the shaft axis line Z13 realizes an upright lie angle as compared with the shaft axis line Z11. In the embodiment, the recessed parts r1 are formed at five positions in the first direction D1. In the embodiment, the lie angle adjustment is enabled at five stages, including the three lie angles.

The lie angle can be adjusted without substantially changing the loft angle in the fixing member Fx1. This can be realized by moving the connector 12 in only the first direction D1 without moving the connector 12 in the second direction D2. The term "without substantially changing" means that the change in the loft angle is less than 0.1 degrees. Thus, in the embodiment, the adjustment of the lie angle and the adjustment of the loft angle are independent of each other.

[Loft Angle Adjustment]

In the embodiment, the movement of the connector 12 in the second direction D2 enables the loft angle adjustment. The movement of the connector 12 in the second direction D2 may enable the lie angle adjustment. For example, the fixing member Fx1 may be rotated by 90 degrees and fixed to the head 4, in order to realize this.

In the embodiment, the recessed parts r2 are formed at five positions in the second direction D2. Therefore, in the embodiment, the loft angle adjustment is enabled at five stages. In the present application, the loft angle means a real loft angle.

The loft angle can be adjusted without substantially changing the lie angle in the fixing member Fx1. This can be realized by moving the connector 12 in only the second direction D2 without moving the connector 12 in the first direction D1. The term "without substantially changing" means that the change in the lie angle is less than 0.1 degrees. Thus, in the embodiment, the adjustment of the lie angle and the adjustment of the loft angle are independent of each other.

As understood from the above description, in the fixing member Fx1, the movement of the connector 12 in the first direction D1 and the movement of the connector 12 in the second direction D2 are linearly perpendicular to each other. That is, the movement in the second direction D2 is enabled without causing the movement in the first direction D1. The movement in the first direction D1 is enabled without causing the movement in the second direction D2. The independence provides a high degree of freedom in the adjustment of the lie angle and the loft angle in the fixing member Fx1.

Both the first direction D1 and the second direction D2 are parallel to the same plane. The first direction D1 and the second direction D2 are perpendicular to each other. These constitutions are suitable for adjusting the loft angle and the lie angle.

As shown in FIG. 8, the fixing member Fx1 has a scale part m1 and a scale part m2. The scale part m1 is an example of a first indicating part indicating the position of the connector 12 in the first direction D1. The scale part m2 is an example of a second indicating part indicating the position of the connector 12 in the second direction D2.

The scale part m1 can be visually recognized from the sole surface side of the head 4. Therefore, the degree of adjustment in the first direction D1 can be easily confirmed. In the embodiment, the confirmation of the lie angle is facilitated by the scale part m1. In the embodiment, the scale part m1 is provided on the scale member 14. The scale part m1 may be provided, for example, on the first sliding member S1. An instruction mark Mk1 is provided on the screw position fixing member 12*b* (see FIG. 12). The confirmation of the degree of adjustment in the first direction D1 is further facilitated by the instruction mark Mk1.

The scale part m2 can be visually recognized from the sole surface side of the head 4. Therefore, the degree of adjustment in the second direction D2 can be easily confirmed. In the embodiment, the confirmation of the loft angle is facilitated by the scale part m2. An instruction mark Mk2 is provided on the scale member 14 (see FIG. 12). The confirmation of the degree of adjustment in the second direction D2 is further facilitated by the instruction mark Mk2. The instruction mark Mk2 may be provided, for example, on the first sliding member S1.

Figure 13:
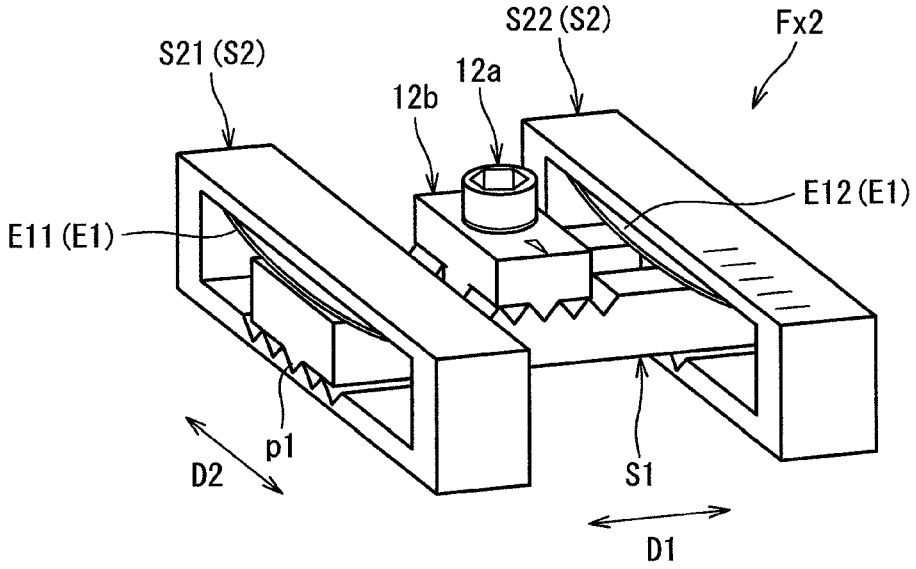
FIG. 13 is a perspective view of a fixing member according to a modification.

FIG. 13 is a perspective view of a fixing member Fx2 as a modification. FIG. 14 is an exploded perspective view of the fixing member Fx2. The fixing member Fx2 is the same as the fixing member Fx1 except that the fixing member Fx2 has an elastic member E1.

The fixing member Fx2 has the elastic member E1. As the elastic member E1, a first elastic member E11 and a second elastic member E12 are provided. The elastic member E11 is disposed on the inner side of the member S21. The elastic member E12 is disposed on the inner side of the member S22. In the embodiment, the elastic member E1 is a blade spring. The constitution and material of the elastic member E1 are not limited. The elastic member E1 may be rubber, for example.

The elastic member E1 biases the first sliding member S1 in a direction in which the first sliding member S1 is engaged with the second sliding member S2. The engagement between the first sliding member S1 and the second sliding member S2 tends to be maintained by the bias.

[Engagement Release X]

Engagement release between the first sliding member S1 and the connector 12 is referred to as engagement release X in the present application. The engagement release X enables the movement of the connector 12 in the first direction D1.

[Engagement Release Y]

Engagement release between the first sliding member S1 and the second sliding member S2 is referred to as engagement release Y in the present application. The engagement release Y enables the movement of the first sliding member S1 in the second direction D2.

[Uneven Structure A]

In the embodiment, engagement between the connector 12 and the first sliding member S1 is achieved by an uneven structure. The uneven structure is also referred to as an uneven structure A.

[Uneven Structure B]

In the embodiment, engagement between the first sliding member S1 and the second sliding member S2 is achieved by an uneven structure. The uneven structure is also referred to as uneven structure B.

[Uneven Overlapping Depth K1]

An uneven overlapping depth in the uneven structure A is shown by a double-headed arrow K1 in FIG. 9. In the embodiment, the uneven overlapping depth K1 coincides with the height of the engaging projection part p3. Naturally, the uneven overlapping depth K1 may not coincide with the height of the engaging projection part p3. In the embodiment, the uneven overlapping depth K1 coincides with the depth of the recessed part r1. Naturally, the uneven overlapping depth K1 may not coincide with the depth of the recessed part r1.

[Uneven Overlapping Depth K2]

An uneven overlapping depth in the uneven structure B is shown by a double-headed arrow K2 in FIG. 10. In the embodiment, the uneven overlapping depth K2 coincides with the height of the engaging projection part p1. Naturally, the uneven overlapping depth K2 may not coincide with the height of the engaging projection part p1. In the embodiment, the uneven overlapping depth K2 coincides with the depth of the recessed part r2. Naturally, the uneven overlapping depth K2 may not coincide with the depth of the recessed part r2.

[Method of Engagement Release X]

In order to achieve the engagement release X, it is necessary to displace the connector 12 more greatly than the depth K1 in comparison with the combined state. The lock part forming body 12*c* is provided at a position in which the engagement release X can be allowed. That is, the lock part forming body 12*c* is provided at a position in which the displacement of the connector 12 (screw position fixing member 12*b*) greater than the depth K1 can be allowed.

Examples of a method for achieving the engagement release X include the following items X1 and X2:

(X1) the screw 12*a* in the combined state is loosened, and the screw 12*a* is retreated based on the screw combination of the screw part 18*a* with the screw hole 6*t*2. The displacement of the screw position fixing member 12*b* exceeding the depth K1 is allowed by retreating the screw 12*a* more greatly than the depth K1. The retreat of the screw 12*a* is achieved by the positioning effect of the screw combination. The retreat means that the length of a screw connecting portion is reduced. The retreat in the embodiment is a movement to the sole side; and (X2) the screw 12*a* in the combined state is loosened, and the screw combination of the screw part 18*a* with the screw hole 6*t*2 is completely released to bring about the uncombined state. In the uncombined state, the screw position fixing member 12*b* is moved to the sole side to realize the engagement release X.

In the case of the method X1, the engagement release X can be achieved while the screw combination of the screw 12*a* with the tip connecting part 6*t* is maintained. Therefore, the screw 12*a* is easily retightened to bring about shift to the combined state again. That is, because the screw combination is not released, the screw is easily tightened again. For example, after the engagement release X is realized by the method X1, and the connector 12 is moved in the first direction D1, the screw 12*a* is easily tightened to bring about the combined state again.

In the method X1, a positional relationship between the tip connecting part 6*t* and the hosel part 4*h* is preferably maintained in the same state as the combined state. The screw 12*a* tends to be retreated to the sole surface side by the maintenance. For example, a method for making the golf club 2 stand so that the sole surface is set to the upper side and rotating the screw 12*a* while pressing a grip end onto the ground or the like can be employed as the maintaining method.

In the method X1, the screw position fixing member 12*b* is moved to the sole side. The movement may be achieved by pulling the screw position fixing member 12*b*, and may be achieved by gravity. When the gravity is utilized, a sole 4*s* of the head 4 is set to the lower side.

In the method X2, the connector 12 is moved to the sole side. The movement may be achieved by pulling the connector 12, and may be achieved by the gravity. In the uncombined state, the connector 12 can be easily moved to the sole side. This is because the non-screw part 18*b* can be freely moved in the through-hole h3 and the insertion part 20 can be freely moved in the through-hole h1. When the gravity is used, the sole 4*s* of the head 4 is set to the lower side. As described above, the falling-off of the screw 12*a* is prevented by the screw part 18*a* and the through-hole h3. Furthermore, the falling-off of the screw position fixing member 12*b* is prevented by the lock part forming body 12*c*.

In respect of realizing the method X2, it is preferable that the screw part 18*a* is not screwed into the through-hole h3 in a state where engagement between the screw part 18*a* and the screw hole 6*t*2 is completely released. In other words, it is preferable that, in the uncombined state, the engagement between the screw part 18*a* and the screw hole 6*t*2 is completely released and only the non-screw part 18*b* exists in the through-hole h3. In the uncombined state, a state where the connector 12 hangs down from the first sliding member S1 can be brought about. In the state, the connector 12 has a high degree of freedom in a movement and a posture. The engagement release X and the positional adjustment of the connector 12 can be facilitated by the high degree of freedom. The screwing of the screw part 18*a* to the screw hole 6*t*2 can be facilitated by the high degree of freedom. Therefore, reshift to the combined state can be facilitated.

When the fixing member Fx2 as a modification is used, the elastic member E1 suppresses the engagement release Y. The fixing member Fx2 can realize the engagement release X and can suppress the engagement release Y. In this case, only adjustment in the first direction D1 can be performed without performing adjustment in the second direction D2. Therefore, the angle adjustment can be facilitated.

[Method of Engagement Release Y]

In order to achieve the engagement release Y, it is necessary to displace the first sliding member S1 more greatly than the depth K2 in comparison with the combined state. A space capable of allowing the engagement release Y is formed in the second sliding member S2. The space is formed by the hole h2. In the case of the fixing member Fx2, the elastic member E1 is disposed by utilizing the space.

Examples of a method for achieving the engagement release Y include the following Y1:

(Y1) the screw 12*a* in the combined state is loosened, and the screw 12*a* is retreated based on the screw combination of the screw part 18*a* with the screw hole 6*t*2. The displacement of the connector 12 exceeding the depth K2 is allowed by retreating the screw 12*a* more greatly than the depth K2. The connector 12 and the first sliding member S1 are then moved to the sole side. The displacement of the first sliding member S1 exceeding the depth K2 is achieved by the movement. The engagement release Y can be achieved by the displacement.

In the method Y1, examples of a method for displacing the first sliding member S1 include the following items Y10, Y11, and Y12:

(Y10) the first sliding member S1 is pulled to the sole side;

(Y11) the connector 12 is pulled, and the first sliding member S1 is moved to the sole side by utilizing engagement between the lock part forming body 12*c* and the first sliding member S1; and (Y12) the first sliding member S1 is moved to the sole side by the gravity.

Examples of a method for realizing the engagement release Y while suppressing the engagement release X in the method Y1 include the following item Y13:

(Y13) while the engagement release X is maintained, the first sliding member S1 and the screw position fixing member 12*b* are pulled, and the first sliding member S1 is moved to the sole side.

In this case, only the second direction D2 can be moved with the position of the first direction D1 fixed. Therefore, the angle adjustment can be facilitated.

When the fixing member Fx2 is used, examples of a method for achieving the engagement release Y include the following item Y2:

(Y2) the engagement between the first sliding member S1 and the second sliding member S2 is released by moving the first sliding member S1 in a direction opposite to the biasing direction of the elastic member E1 against the biasing force of the elastic member E1.

The item Y2 can be achieved by the item Y10, Y11, or Y12. It is preferable that the item Y2 is not achieved by the gravity in respect of realizing the engagement release X while suppressing the engagement release Y. That is, it is preferable that the elastic member E1 is not deformed to such an extent that the engagement release Y is realized by the gravity acting on the connector 12. In this case, only the first direction D1 is easily moved with the position of the second direction D2 fixed in a state where the sole 4*s* is turned downward and the connector 12 hangs down from the first sliding member S1.

Figure 15:
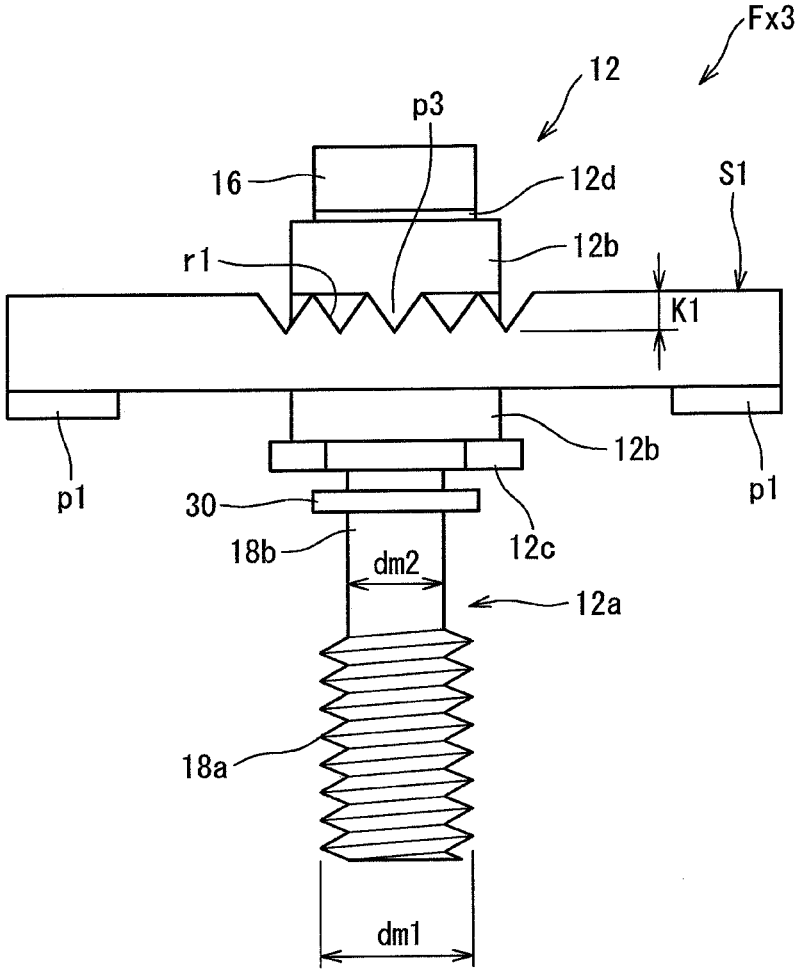
FIG. 15 is a side view showing a part of a fixing member according to another modification.

FIG. 15 is a side view of a fixing member Fx3 as a modification. In the fixing member Fx3, the screw 12*a* has an outer extending part 30. The outer extending part 30 is provided in the non-screw part 18*b* of the screw 12*a*. The outer extending part 30 is projected outward in the radial direction of the non-screw part 18*b*. The fixing member Fx3 is the same as the fixing member Fx1 except for the existence or nonexistence of the outer extending part 30.

The outer extending part 30 is a member different from the screw 12*a*. The outer extending part 30 has an almost ring-shaped member. Preferred examples of the outer extending part 30 include an O ring and a retaining ring. Examples of the retaining ring include a C ring (C-type retaining ring) and an E ring (E-type retaining ring).

After the screw part 18*a* passes through the through-hole h3, the outer extending part 30 is fixed to the non-screw part 18*b*. In order to ensure the fixation of the outer extending part 30, a recessed part such as a circumferential groove may be formed in the non-screw part 18*b*. The fixation of the outer extending part 30 is ensured by fitting the outer extending part 30 into the recessed part. For example, the outer extending part 30 which is the E ring is fitted into the circumferential groove of the non-screw part 18*b*. The outer extending part 30 fixed to the non-screw part 18*b* cannot pass though the through-hole h3. The movement of the non-screw part 18*b* in the through-hole h3 is regulated by the existence of the outer extending part 30.

As described above, the screw 12*a* can be retreated by loosening the screw 12*a*. The outer extending part 30 can be brought into contact with the end face of the insertion part 20 and/or the lock part forming body 12*c* by the retreat. When the screw 12*a* is further retreated, the screw position fixing member 12*b* is moved with the screw 12*a*. That is, the outer extending part 30 and the connector 12 are brought into contact with each other, and thereby the connector 12 is moved while being linked with the retreat of the screw 12*a*. When the moving distance of the connector 12 exceeds the depth K1, the engagement release X is achieved. In this case, the engagement release X can be automatically achieved by merely loosening the screw 12*a*. The engagement release X is easily achieved without causing the engagement release Y. Therefore, the connector 12 is easily moved only in the first direction D1.

In an example of a preferred embodiment, the uneven overlapping depth K1 and the uneven overlapping depth K2 are made different. That is, K1>K2 is set, or K2>K1 is set.

In the case of K1>K2, the engagement release Y is easily realized while the engagement release X is suppressed. Therefore, only an engaging position in the second direction D2 is easily moved without moving an engaging position in the first direction D1. Therefore, the angle adjustment can be facilitated.

In the case of K2>K1, the engagement release X is easily realized while the engagement release Y is suppressed. Therefore, only the engaging position in the first direction D1 is easily moved without moving the engaging position in the second direction D2. Therefore, the angle adjustment can be facilitated.

In respect of the degree of freedom of the angle adjustment, the adjustment range of the lie angle is preferably equal to or greater than 1 degree, and more preferably equal to or greater than 2 degrees. In respect of the miniaturization of the fixing member, the adjustment range of the lie angle is preferably equal to or less than 5 degrees, and more preferably equal to or less than 4 degrees.

In respect of the degree of freedom of the angle adjustment, the adjustment range of the loft angle is preferably equal to or greater than 1 degree, and more preferably equal to or greater than 2 degrees. In respect of the miniaturization of the fixing member, the adjustment range of the loft angle is preferably equal to or less than 5 degrees, and more preferably equal to or less than 4 degrees.

The loft angle and the lie angle can be measured by a known measuring device. Examples of the measuring device include a golf club head gauge manufactured by Sheng Feng Company.

The invention described above can be applied to all golf clubs.

The description hereinabove is merely for an illustrative example, and various modifications can be made in the scope not to depart from the principles of the present invention.

What is claimed is:

1. A golf club comprising a head, a shaft, and a fixing member for fixing the shaft, wherein the head has a hosel part capable of swingably supporting the shaft;

the shaft has a tip connecting part capable of being connected to the fixing member;

the fixing member has a connector capable of being connected to the shaft, a first sliding member capable of engaging the connector with a plurality of positions in a first direction, and a second sliding member capable of engaging the first sliding member with a plurality of positions in a second direction; and a movement of the connector in the first direction and a movement of the connector in the second direction are linearly perpendicular to each other.

2. The golf club according to claim 1, wherein a lie angle can be changed by any one of the movement of the connector in the first direction and the movement of the connector in the second direction, and a loft angle can be changed by the other.

3. The golf club according to claim 1, wherein the fixing member has a first indicating part indicating a position of the connector in the first direction; and the first indicating part can be visually recognized from a sole surface side of the head.

4. The golf club according to claim 1, wherein the fixing member has a second indicating part indicating a position of the connector in the second direction; and the second indicating part can be visually recognized from a sole surface side of the head.

5. The golf club according to claim 1, wherein the connector has a screw and a screw position fixing member;

the tip connecting part has a female screw part; and the shaft is fixed to the head by screw combination of the screw with the female screw part.

6. The golf club according to claim 5, wherein the screw position fixing member and the first sliding member can be engaged at the plurality of positions in the first direction.

7. The golf club according to claim 6, wherein the engagement between the screw position fixing member and the first sliding member is fixed by an axial force of the screw combination.

8. The golf club according to claim 1, further comprising an elastic member biasing the first sliding member in a direction in which the first sliding member is engaged with the second sliding member.

9. The golf club according to claim 8, wherein the engagement between the first sliding member and the second sliding member is released by moving the first sliding member in a direction opposite to the biasing direction of the elastic member against an biasing force of the elastic member; and the first sliding member can be moved in the second direction by releasing the engagement.

10. The golf club according to claim 1, wherein engagement between the connector and the first sliding member is achieved by an uneven structure A;

engagement between the first sliding member and the second sliding member is achieved by an uneven structure B; and an uneven overlapping depth in the uneven structure B is different from an uneven overlapping depth in the uneven structure A.

11. The golf club according to claim 1, wherein the hosel part has a hosel hole; and the hosel hole widens toward the lower part thereof in a portion into which the tip connecting part can be inserted.

12. The golf club according to claim 1, wherein the hosel part has an end face; and the end face can support an axial force acting on the tip connecting part.

13. The golf club according to claim 1, further comprising an annular elastic body, wherein the hosel part has an end face;

the tip connecting part has a protrusion surface;

the annular elastic body is disposed between the end face and the protrusion surface; and a gap between the protrusion surface and the end face is filled by deformation of the annular elastic body in all adjusted angles.

14. The golf club according to claim 1, wherein the tip connecting part has a projection curved surface part;

the hosel part has a recessed curved surface part; and the projection curved surface part and the recessed curved surface part are brought into contact with each other.

15. The golf club according to claim 1, wherein the tip connecting part has a rotation prevention projection part;

the hosel part has a rotation prevention recessed part; and rotation prevention of the shaft is achieved by engagement between the rotation prevention projection part and the rotation prevention recessed part.

16. The golf club according to claim 2, wherein the lie angle can be adjusted without substantially changing the loft angle.

17. The golf club according to claim 2, wherein the loft angle can be adjusted without substantially changing the lie angle.

* * * * *